US005435640A

United States Patent [19]

Holcomb

[11] Patent Number: 5,435,640

[45] Date of Patent: Jul. 25, 1995

[54] DRAWER CATCH CONSTRUCTION

[75] Inventor: Gregory J. Holcomb, Cedar Falls, Iowa

[73] Assignee: Waterloo Industries, Inc., Waterloo, Iowa

[21] Appl. No.: 86,932

[22] Filed: Jul. 2, 1993

[51] Int. Cl.[6] ..... E05C 7/06

[52] U.S. Cl. ..... 312/221; 312/333

[58] Field of Search ..... 312/333, 222, 221; 292/17

[56] References Cited

U.S. PATENT DOCUMENTS 2,711,944 6/1955 Meek ..... 312/333
4,250,599 2/1981 Nagashima ..... 292/17

OTHER PUBLICATIONS

Drawer Retainer Drawing, Waterloo Industries, Inc. (Nov. 13, 1989); and Instructions for Drawer Removal and Installation of Drawer Modulatory and Drawer Retainer (Undated).

Drawer Interlock Drawing, Waterloo Industries, Inc. (Mar. 4, 1991).

Drawer Installation Drawing, Waterloo Industries, Inc. (Jul. 23, 1979); and 10,000 Drawer Drawing, Waterloo Industries, Inc. (Undated).

Unit Assembly Drawing, Waterloo Industries, Inc. (Aug. 13, 1992); Lock Bar Drawing, Waterloo Industries, Inc. (Oct. 11, 1991); and Unit Weldment Drawing, Waterloo Industries, Inc. (Oct. 19, 1991).

Roller Slide-LT Drawing, Waterloo Industries, Inc. (Jan. 8, 1991).

Stanley Products Catalog, Cabinet Catches and Latches, Roller Cabinet Catch, Catalog No. CD34 and 38 (Undated).

*Primary Examiner*—Kenneth J. Dorner
*Assistant Examiner*—Gerald A. Anderson
*Attorney, Agent, or Firm*—Banner & Allegretti, Ltd.

[57] ABSTRACT

A drawer catch construction for a drawer and cabinet combination includes a plastic drawer catch comprised of spaced parallel legs which is fitted through an opening in the back side of the drawer and cooperates with a bar positioned on the inside of the cabinet to latch the drawer closed.

4 Claims, 2 Drawing Sheets

Fig. 3
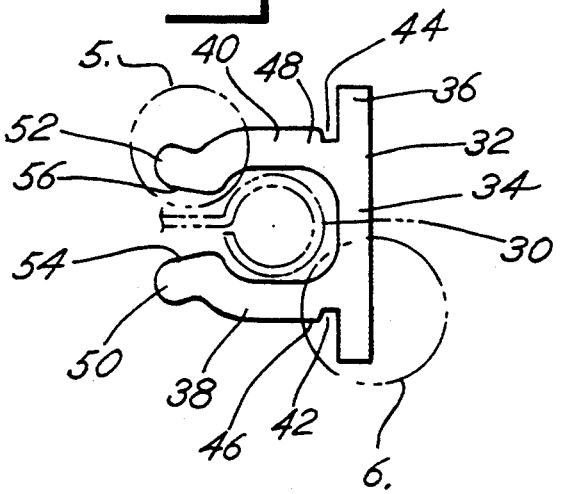
Fig. 5
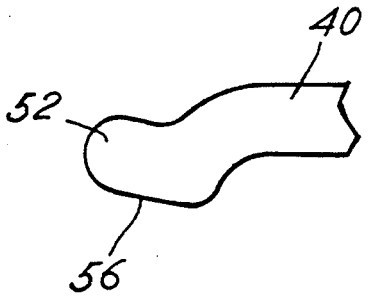
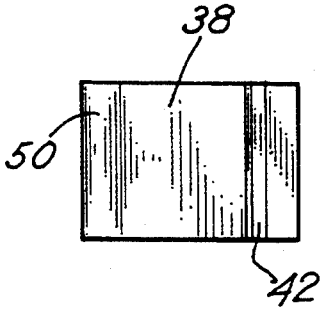
Fig. 4
Fig. 6
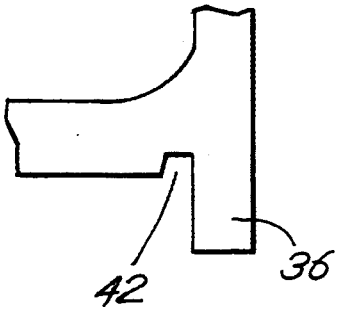

DRAWER CATCH CONSTRUCTION

BACKGROUND OF THE INVENTION

This invention relates to an improved mechanism for retaining a drawer in a closed position in a cabinet by means of a catch construction.

Drawers in cabinets equipped with low friction slides may open inadvertently particularly when the cabinet is being moved. This is a problem which may occur, for example, with respect to rolling tool chests or tool cabinets. Various mechanisms have been devised, therefore, to retain the potentially sliding drawers in a closed position, particularly when the cabinet containing the drawers is to be moved. For example, an overcenter acting spring biased retaining clamp may be used to engage a metal bar or rod to thereby hold the drawers closed. Another mechanism that has been used is a friction clamp which fits against the side of each drawer whenever the drawer is in the closed position. Latches may also be used to hold drawers in a closed position. Such latches may be manually or key operated, for example. The slide which supports the drawer may also include a detent associated with the closed position of the drawer. Rollers or bearings for the drawer will fit into the detent and maintain the drawer closed. The force associated with such a detent construction is often higher than desired. Various types of cabinet catches and latches using male and female interacting latching mechanisms are also useful.

While each of these mechanisms is useful, they are rather cumbersome, can be expensive to make and maintain and are not easily replaced in the event of a defect or in the event the latching force is to be altered or changed. Thus there has remained a need for an improved drawer detent or catch construction.

SUMMARY OF THE INVENTION

In a principal aspect the present invention comprises a drawer catch or detent construction which is positioned on the back side of a sliding drawer and cooperates with a retaining bar positioned on the back side of the cabinet in opposed relation to the back side of a cabinet drawer. The detent mechanism is fabricated or molded from a flexible plastic resin, and is defined by a pair of spaced opposed legs joined by a crown. The legs are flexible and are designed to fit over a rigid retaining bar. The legs are joined to the crown or plate in a fashion which permits the device to be snapped fitted into an opening in the back side of the drawer panel in a manner which permits the legs to be oriented for overlapping the retaining bar when the drawer is closed.

Thus it is an object of the invention to provide an improved drawer catch construction.

It is a further object of the invention to provide an improved drawer catch construction comprised of an elastic material which may be snapped fitted into the back side of a sheet metal drawer for cooperation with a compatible strike member associated with the back side of the cabinet.

It is yet another object of the invention to provide an improved drawer catch construction which may be easily replaced and repaired.

A further object of the invention is to provide a drawer catch construction which may be constructed of various materials to provide for a variety of drawer catch retaining force to move the drawer from a detent or locked position to an unlocked position.

Another object is to provide a detent which requires a lower face to close the drawer than to open the drawer.

Yet another object of the invention is to provide an improved drawer catch construction which is easy to manufacture, economical to repair and replace, and which also has a simple, yet rugged construction.

These and other objects, advantages and features of the invention will be set forth in the detailed description which follows.

BRIEF DESCRIPTION OF THE DRAWINGS

In the detailed description which follows, reference will be made to the drawing comprised of the following figures:

FIG. 3 is a top plan view of the improved catch member; FIG. 4 is a side view of the member of FIG. 3; FIG. 5 is an enlarged view of a portion of the leg of the member of FIG. 3; and FIG. 6 is an enlarged plan view of the crown and leg construction showing a slot for cooperation with an opening in the panel depicted in FIG. 2.

DESCRIPTION OF THE PREFERRED EMBODIMENT

Figure 1:
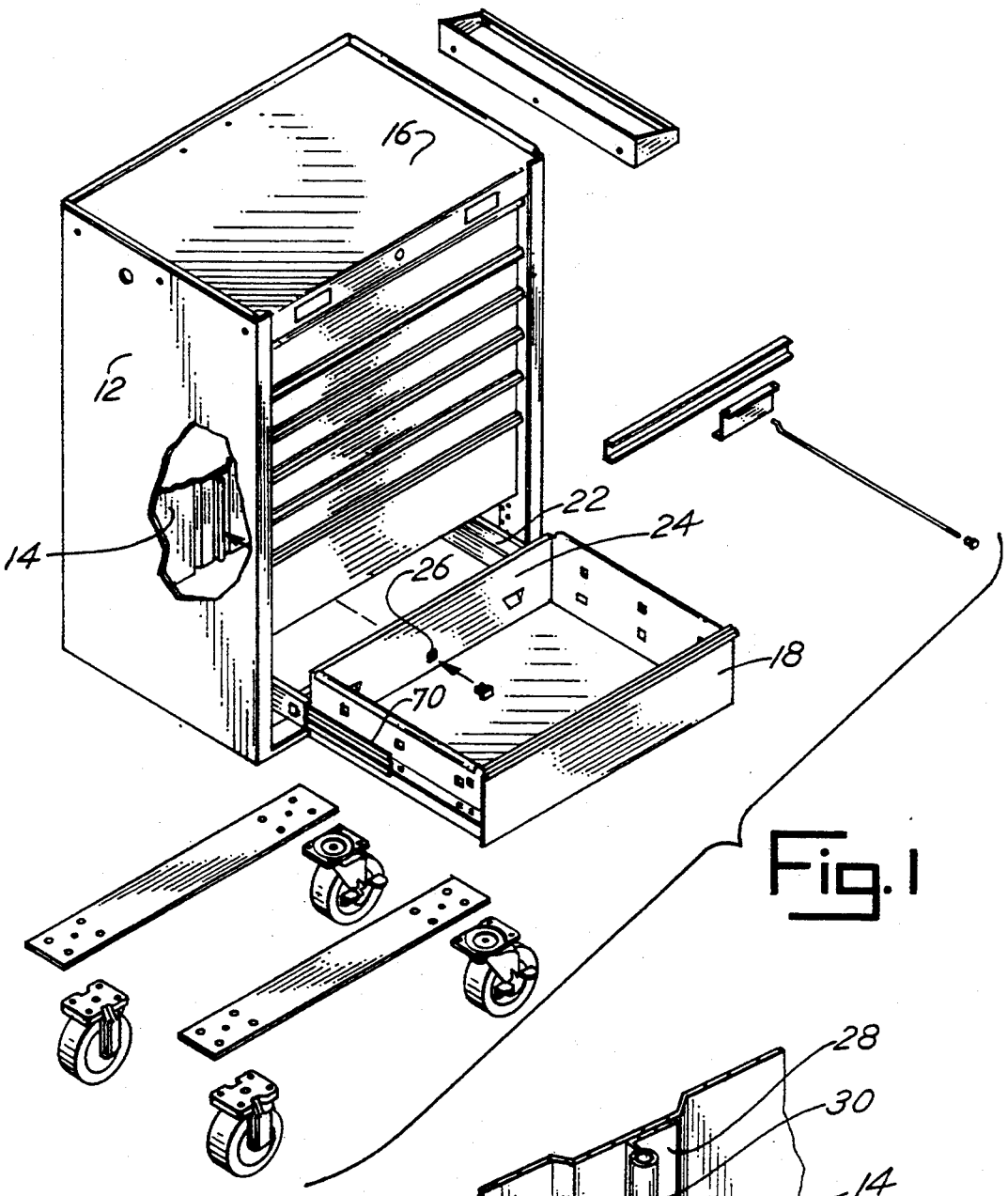
FIG. 1 is a perspective view of a sheet metal cabinet which incorporates the improved drawer detent construction of the present invention.
Figure 2:
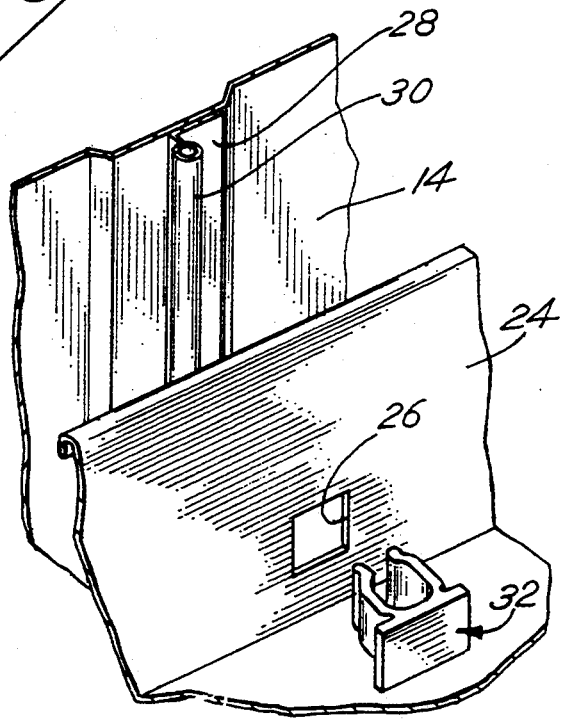
FIG. 2 is an enlarged perspective view of improved catch construction of the invention.

Referring to FIGS. 1 and 2 there is illustrated a typical sheet metal work cabinet 10 which includes side panels, such as side panel 12, a back panel 14, a top panel 16 and a plurality of sliding drawers 18 supported between the side panels. The drawers 18 include side, slide mechanisms 20 which cooperate with side, slide members 22 attached to the side panels, such as side panel 12. In this manner, the drawers 18 are slidable into and out of the cabinet 10. Each of the drawers 18 includes a back side panel 24 defined or formed of sheet metal. A generally rectangular or square through passage 26 is defined in the back or through each back panel 24.

As depicted in FIG. 2, the back side 14 of the cabinet 10 includes a bracket 28 having a generally cylindrical cross-section shaped bar or strike 30 which is aligned with the through passage 26 in the back side or back panel 24 of the drawer 18. The improved plastic detent or catch 32 of the invention cooperatively fits through the through passage 26 and flexibly engages the strike 30.

Referring to the remaining figures, there is illustrated in greater detail the construction of the plastic detent or catch 32 and also the detail of the manner in which that catch 32 cooperates with the bar shape or strike 30. Specific reference is directed to FIGS. 3 through 6. There it is seen that the catch 32 includes a crown 34 which defines a generally rectangular shaped plate 36. The crown 34 connects opposed, generally parallel, spaced legs 38 and 40. The legs 38, 40 are attached to the crown 32 and thus to the plate 36. The legs are formed integrally with the crown 32 and plate 36. The legs 38, 40 are joined to the plate 36 and define slots 42 and 44 which are dimensioned so as to cooperate with the sides of passage 26. Thus when the catch 32 is positioned through the passage 26, the generally parallel legs 38 and 40, which are spaced a standard distance or deviation from one another, can be flexed toward one another to thereby permit ribs or edges 46 and 48 of the slots 42 and 44, respectively to move toward one another thereby permitting the slots 46 and 44 to be tightly engaged against the side edges of the passage 26 in panel 24. Release of legs 38 and 40 will cause those legs 38, 40 to assume the position illustrated in FIG. 3; namely, the position of a standard spaced distance from one another.

Each of the legs 38 and 40 also includes an inwardly extending rib 50 and 52 in opposed relation to one another at their distal ends. The ribs 50, 52 are configured to include converging surfaces 54 and 56 which converge toward the crown 34. Thus, the legs may be fitted over the strike 30 by engaging the surfaces 54 and 56 against the outside surface of the strike 30 causing the legs 38 and 40 to flex outwardly. Because of the ribs 50 and 52 are spaced from each other by a distance less than the diameter of the strike 30, the legs 38, 40 will be flexed outwardly causing the ribs 50, 52 to fit over and around the strike 30. It is to be noted that the length or depth of the legs 38, 40 is such that the legs 38, 40 can surround the strike 30 and retain the strike 30 therebetween. Thus the ribs 52 and 54 are spaced from the plate 36 a sufficient distance to encircle the strike, and are normally spaced from each other by a distance less than the diameter of the strike 30.

It is possible to vary the composition of material from which the catch 32 is manufactured to thereby vary the elasticity and thus the holding strength of the catch 32 with respect to the strike 30. It is also possible to use a multiplicity of catches 32 in combination with a number of strike 30 or to utilize an elongated catch 32. As depicted in FIG. 4, the height of the catch 32 and other dimensions can be varied significantly to thereby control the holding characteristics. With the construction of the invention, each of the drawers is independently retained. A specific catch 32 may thus be utilized and designed for each of the drawers 18 depending upon the size of the drawers and the material which is to be stored therein. In this manner, improved customization of the retaining characteristics of a multi-drawered cabinet may be provided. Of course the shape of the opening or passage 26 may be varied. The cross-sectional shape of the legs 38, 40, the dimensions of the legs 38, 40, the shape of the strike 30 and the shape of the plate 36 may also be varied without departing from the spirit and scope of the invention. Thus the invention is to be limited only by the following claims and their equivalents.

What is claimed is:

1. A two part drawer catch construction in combination with a drawer and cabinet comprising in combination:

a cabinet including a back side and side walls with parallel side slide members;

a drawer including a back side and further including side slide supports cooperative with the side slide members of the cabinet whereby the drawer is slidable between an open and closed position, with the cabinet back side closely opposed to the drawer back side when the drawer is closed and spaced when the drawer is open;

an elastic catch member comprising a single integral elastic member including first and second integral, spaced, generally parallel legs connected by a crown, each leg being flexible to permit variation of the distance between the legs from a standard spacing, each leg also including an opposed end rib extending from each leg toward the opposed leg to define a spacing less than the standard spacing, said crown affixed to the back side of the drawer or cabinet and extending toward the backside of the cabinet or drawer respectively; and a locking strike positioned on the back side of the drawer or cabinet in opposed relation to the spaced legs projecting from the cabinet or drawer respectively, said strike shaped with a generally cylindrical cross section for receipt and gripping engagement by encirclement of the legs when the drawer is closed by flexing to fit over the locking strike.

2. The construction of claim 1 wherein the drawer back side is fabricated from sheet metal and includes a passage for receipt of the elastic member, said elastic member comprising:

spaced legs joined along one side by the crown, said legs projecting through the passage and from the back side of the drawer toward the back side of the cabinet, said crown including a facing plate having a dimension greater than the passage and further including slots defined between the legs and facing plate for receipt of the sides of the passage in the back side of the drawer to thereby retain the elastic member in the back side of the drawer.

3. The construction of claim 2 wherein the locking strike comprises a generally cylindrical cross-section rod in opposed relation to the back side of the drawer and in position to be engaged between the legs of the elastic member, said rod having a diameter greater than the standard spacing of the legs.

4. The construction of claim 1 wherein the drawer backside comprises a sheet metal panel with an opening with edges for elastically receiving the catch, said catch comprising:

a unitary, molded elastic member including the first and second spaced legs joined by the crown, said legs being generally parallel, uniformly spaced, and elastically deformable to spread and fit over the strike;

each said legs including a distal end with the rib projecting toward the other leg, said legs joined by a crown plate of a size greater than the size of the sheet metal panel opening;

said crown including opposed outwardly extending slots defined at the juncture of the legs and plate, said slots spaced and sized to receive the edges of the opening in the sheet metal panel, said legs sufficiently flexible to permit the legs to be moved toward one another to engage the sides of said opening, said legs being flexed away from each other when positioned over opposite sides of the strike;

said strike comprising a generally cylindrical bar positioned a fixed distance from the back side of the cabinet and aligned with the opening between the legs of the catch, whereby the catch and strike comprise a two piece construction.

* * * * *